US008968109B2

(12) United States Patent
Stoker

(10) Patent No.: US 8,968,109 B2
(45) Date of Patent: Mar. 3, 2015

(54) AGGRESSIVE LINEAR ACCELERATION SYSTEM (A.L.A.S.) MOTION RIDE METHOD

(76) Inventor: Daniel James Stoker, Tucson, AZ (US)

( * ) Notice: Subject to any disclaimer, the term of this patent is extended or adjusted under 35 U.S.C. 154(b) by 326 days.

(21) Appl. No.: 13/176,965

(22) Filed: Jul. 6, 2011

(65) Prior Publication Data

US 2013/0012328 A1 Jan. 10, 2013

(51) Int. Cl.
*A63G 31/16* (2006.01)
*A63G 1/48* (2006.01)
*A63G 7/00* (2006.01)

(52) U.S. Cl.
CPC . *A63G 31/16* (2013.01); *A63G 1/48* (2013.01)
USPC ..... 472/59; 472/43; 472/130

(58) Field of Classification Search
USPC ..... 472/59–61, 43, 47, 130; 434/28, 29, 55
See application file for complete search history.

(56) References Cited

U.S. PATENT DOCUMENTS 6,077,078 A * 6/2000 Alet et al. ..... 434/55
6,910,971 B2 6/2005 Alsenz
7,866,982 B1 * 1/2011 Whitsitt ..... 434/28
8,356,996 B2 * 1/2013 Mayrhofer ..... 434/55
2010/0216097 A1 * 8/2010 Romagnoli et al. ..... 434/35

* cited by examiner

*Primary Examiner* — Kien Nguyen
(74) *Attorney, Agent, or Firm* — Hayes Soloway P.C.

(57) ABSTRACT

A method utilizes reduced operational time and motion paths with consequently reduced manufacturing, operational, and maintenance costs relative to roller coasters, motion simulators, and other similar thrills rides currently in use. This method is accomplished by an Aggressive Linear Acceleration System (A.L.A.S.) maneuver, which is defined as 1) moving a passenger vehicle (107) at a constant angular speed (A) about one central axis of rotation (105), 2) moving passenger vehicle (107) at constant angular speed (A) about central axis of rotation (105), and away from central axis of rotation (105) at an increasing speed by a negative driven acceleration C, and 3) moving passenger vehicle (107) at constant angular speed (A) about central axis of rotation (105), and away from central axis of rotation (105) at a decreasing speed by a positive driven acceleration E. Consequently, the A.L.A.S. maneuver removes current limitations of amusement and thrill rides allowing for incorporations of simulation and motion technologies that presently are not viable.

8 Claims, 5 Drawing Sheets

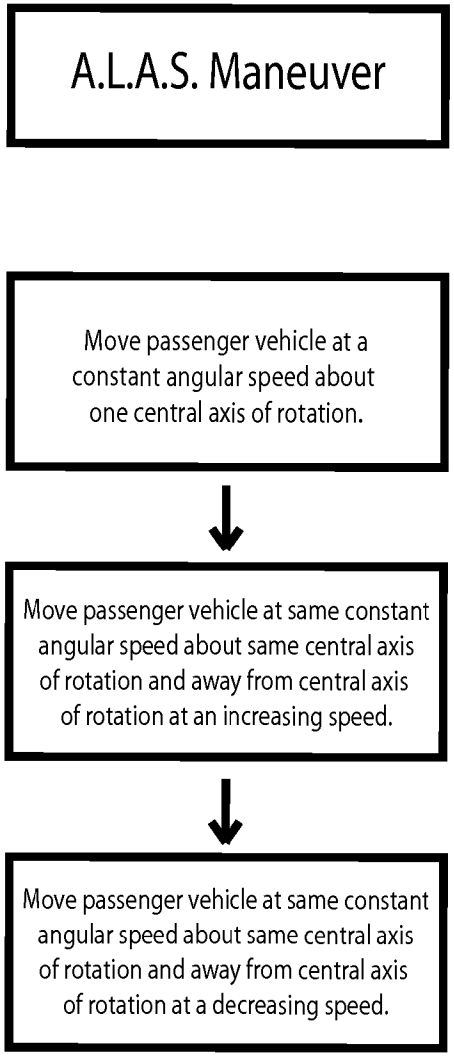

FIG. 4

Computer Program for Executing A.L.A.S. Maneuver

```
int main()
{
        int runTime1, runTime2, runTime3;
        double centripetalAccel, tangentialAccel;
        double negDrivenAccel, posDrivenAccel, netAccel;
        double radialPos = 0.0;
        double radialVar = 0.0;
        double angularVel = 1.0;
        double stepTime = 0.5;
        double loopValue = 1.0;

        for (runTime1 = 0; runTime1 <=8; runTime1++)
        {
                centripetalAccel = radialPos*angularVel*angularVel;
                tangentialAccel = angularVel*radialVar/stepTime;
                negDrivenAccel = -(radialVar/stepTime/stepTime);
                netAccel = centripetalAccel + negDrivenAccel;
        }
        for (runTime2 = 9; runTime2 <=12; runTime2++)
        {
                radialPos = radialPos + loopValue;
                radialVar = loopValue;
                loopValue = loopValue + 0.3;
                centripetalAccel = radialPos*angularVel*angularVel;
                tangentialAccel = angularVel*radialVar/stepTime;
                negDrivenAccel = -(radialVar/stepTime/stepTime);
                netAccel = centripetalAccel + negDrivenAccel;
        }
        for (runTime3 = 13; runTime3 <=15; runTime3++)
        {
                radialPos = radialPos + loopValue;
                radialVar = loopValue;
                loopValue = loopValue - 0.6;
                centripetalAccel = radialPos*angularVel*angularVel;
                tangentialAccel = angularVel*radialVar/stepTime;
                posDrivenAccel = radialVar/stepTime/stepTime;
                netAccel = centripetalAccel + posDrivenAccel;
        }
return 0;
}
```

FIG. 5

AGGRESSIVE LINEAR ACCELERATION SYSTEM (A.L.A.S.) MOTION RIDE METHOD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

SEQUENCE LISTING

Not Applicable

BACKGROUND OF THE INVENTION

1. Field

This application relates to, but not exclusively, fields of roller coasters, motion simulators, and similar thrill rides, and is further relevant to industries of entertainment, manufacturing, automobile and flight simulation, and experimental research.

2. Prior Art

A current problem plaguing amusement rides, manufacturers have not fully acknowledged nor resolved, is a competing consumption of spatial and temporal resources that limits motion and simulator parameters. Roller coasters, on the one hand, create high accelerations in a short period of time but over long paths of track. Motion simulators, on the other hand, are confined in small spaces but either take considerable time to reach higher accelerations or create incomplete sensations of such motions. The principle technologies of these machines have been known and explored for more than a century; however, none have created a motion ride method to address the problem that this publication identifies and solves. Two patents are identified as prior art.

U.S. Pat. No. 6,910,971 to Alsenz (2005) describes an apparatus for and a method of producing a virtual reality effect of changing acceleration direction and magnitude by rotating a subject relative to a center axis to produce a centrifugal force, rotating the subject relative to a second axis perpendicular to centrifugal force and rotating the subject relative to a third axis perpendicular to the axis perpendicular to centrifugal force, and changing the magnitude of the centrifugal force.

W.O. Pat. No. 2,008,081,406 to Romagnoli et al. (2010) describes a machine where the first part has a circular motion with respect to its vertical axis of rotation and is supported by a fixed base, the second part, integral to the first part has a longitudinal movement (horizontal) perpendicular to the rotation axis of the first part, and the third part, integral to the second part, acts as positioning for the user who is subject to the simulator's effects which has a circular motion with respect to its vertical axis of rotation that is parallel to the axis of rotation of the first part.

Objectives and Advantages of the Invention

As stated previously, a problem in fields of roller coasters, motion simulators, and similar thrill rides is a competing need for spatial and temporal resources that limits motion and simulator parameters. U.S. Pat. No. 6,910,971 to Alsenz (2005) and W.O. Pat. No. 2,008,081,406 to Romagnoli et al. (2010) are motion simulator designs identified as similar technologies to preferred apparatus described in this application. There are, however, important differences.

First, these simulator designs require at least two separate rotational axes. A first axis of rotation runs through a center of a rotating platform. A passenger vehicle, capable of carrying at least one passenger, linearly travels a surface diameter of the rotating platform. A second axis runs through the body of the passenger vehicle. A machine described herein for use of an Aggressive Linear Acceleration System (A.L.A.S.) maneuver operates only the first of these rotational axes through a center of a rotating platform. The absence of a second rotational axis through a body of a passenger vehicle, as presented in accompanying drawings, is a strong distinction between prior art and the A.L.A.S. maneuver, and further reduces manufacturing, operational, and maintenance costs.

Second, the A.L.A.S. maneuver uses a method of cancellation and addition of radial accelerations neither mentioned nor explored in any prior art. This is accomplished by a driven acceleration; a term defined in this publication as acceleration in a radial direction from a source that is controllable and separate from a centripetal acceleration of a system experiencing rotational motion. Furthermore, driven acceleration with centripetal acceleration represents all radial accelerations of the system. In the second step of the A.L.A.S. maneuver, driven acceleration created in an opposing direction to the centripetal acceleration for a rotating passenger vehicle is defined as negative driven acceleration. Negative driven acceleration execution, in the second step, results in partial to complete cancellation of radial forces. In the third step, driven acceleration created in the same direction as the centripetal acceleration for a rotating passenger vehicle is defined as positive driven acceleration. Positive driven acceleration execution, in the third step, results in addition of radial forces. These changes in magnitude and direction of the driven acceleration are essential for enabling a passenger or passengers, within the passenger vehicle, to experience a full effect of the A.L.A.S. maneuver.

Lastly, prior art publications focus primarily on potential uses of simulator designs for simulated motions, whereas the current application is starkly differentiated from prior art as an established and well defined method to achieve a set of real motions. As a result, the detail of descriptions for use of the A.L.A.S. maneuver as a versatile method applicable to a large variety of technologies and industries is unprecedented in these previous publications, either individually or in combination.

Consequently, the A.L.A.S. maneuver removes current spatial and temporal parameter limitations of amusement rides allowing for incorporation of simulation and motion technologies that presently are not viable. For example, roller coasters produce strong and quick linear accelerations but can't come close to creating a user environment akin to motion simulators that utilize sophisticated digital, audio, and software platforms in a confined space, and vice versa. The A.L.A.S. maneuver, however, makes possible a motion and simulation environment complimentary to both technologies.

BRIEF SUMMARY OF THE INVENTION

The current application describes a motion ride method for producing a quick and powerful linear acceleration of a passenger vehicle within a confined space. This solves a current problem in fields of roller coasters, motion simulators, and similar thrill rides, of which there is a contending requisite of spatial and temporal resources that limits motion and simulator parameters. This is accomplished by a method of 1) moving a passenger vehicle, at a constant angular speed about one central axis of rotation, 2) moving the passenger vehicle, at same constant angular speed about same central axis of rotation, and away from central axis of rotation at an increasing speed, and 3) moving the passenger vehicle, at same constant angular speed about same central axis of rotation, and away from central axis of rotation at a decreasing speed, whereby executes the A.L.A.S. maneuver.

In applications of the A.L.A.S. maneuver, three embodiments are explored using same equations of motion but with varied parameters. Centripetal and tangential accelerations arise from centripetal motion with direction in the radial and tangential paths, respectively. Driven acceleration is created separate and controllable from all other accelerations and in the radial direction. Consequently, step one, of the described method, undergoes a negligible tangential force and negligible net radial force acting on a passenger, or passengers, within the passenger vehicle. Step two undergoes a negligible tangential force and cancelling radial forces resulting in a negligible net radial force acting on a passenger, or passengers, within the passenger vehicle. Step three undergoes negligible tangential force and adding radial forces resulting in a substantial net radial force, creating a sudden and large rise in the net force in the radial direction felt by the passenger, or passengers, within the passenger vehicle.

BRIEF DESCRIPTION OF THE SEVERAL VIEWS OF THE DRAWINGS

FIG. 4 is a flowchart of the A.L.A.S. maneuver.

FIG. 5 is a computer program used to calculate kinematic data of the A.L.A.S. maneuver.

ELEMENTS AND FUNCTIONS

Table of Element Numbers, Characters, and Descriptions

| Element Number/Character | Element Description |
|---|---|
| 101 | Rotating platform |
| 103 | Platform track |
| 105 | Central axis of rotation |
| 107 | Passenger vehicle |
| 109 | Passenger |
| A | Constant angular speed |
| C | Negative driven acceleration |
| E | Positive driven acceleration |
| G | Centripetal acceleration |
| K | Tangential acceleration |
| P | Net radial acceleration |

DETAILED DESCRIPTION OF THE INVENTION

Figure 1A:
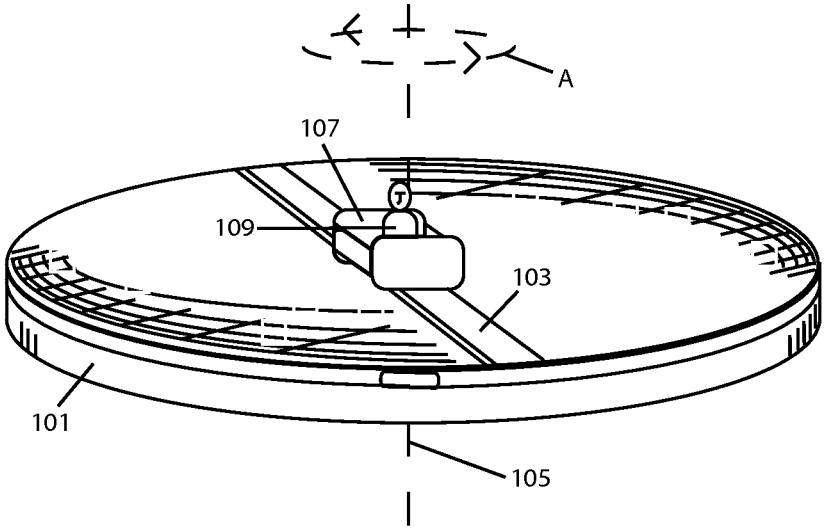
FIGS. 1A and 1B are side and top views, respectively, of a preferred machine in step one of the A.L.A.S. maneuver.
Figure 1B:
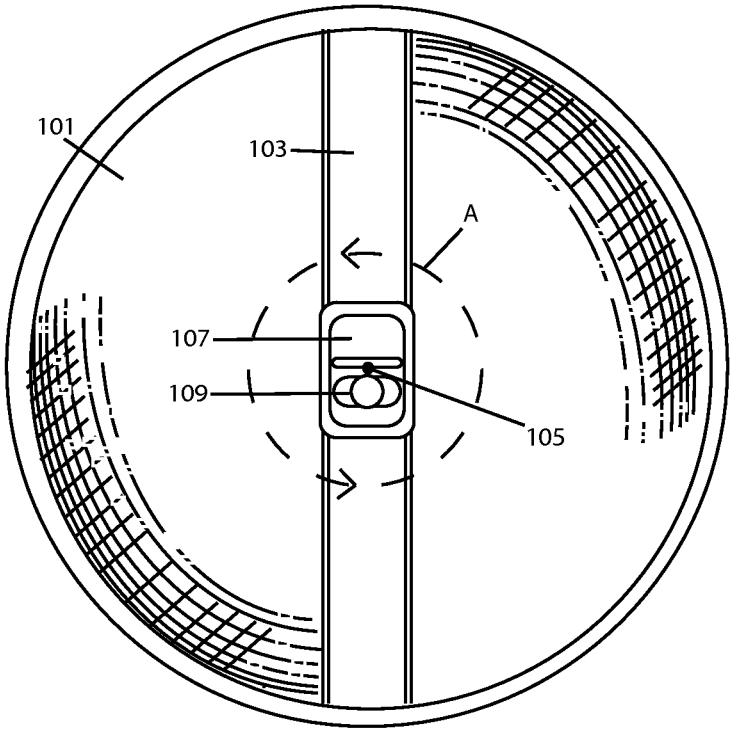

In FIGS. 1A, 1B, 2A, 2B, 3A, and 3B, a preferred machine for execution of the A.L.A.S. maneuver is presented. In FIG. 1A (side view) and FIG. 1B (top view), step one of the A.L.A.S. maneuver is displayed. A passenger 109 is within a passenger vehicle 107. Passenger vehicle 107 rests on a platform track 103. Platform track 103 lies on the surface of a rotating platform 101 and through a central axis of rotation 105. Rotating platform 101 has a counterclockwise constant angular speed A.

Figure 2A:
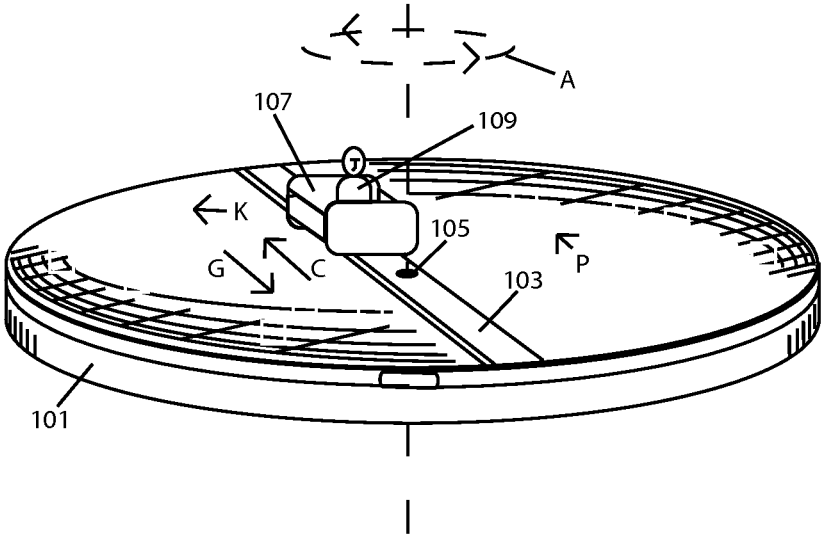
FIGS. 2A and 2B are side and top views, respectively, of a preferred machine in step two of the A.L.A.S. maneuver.
Figure 2B:
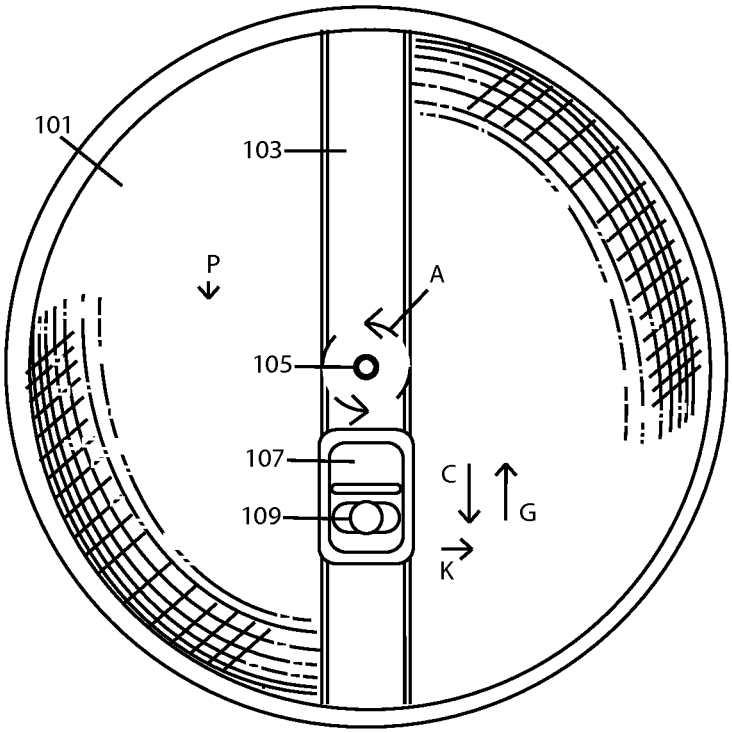

In FIG. 2A (side view) and FIG. 2B (top view), step two of the A.L.A.S. maneuver is displayed. Passenger 109 is within passenger vehicle 107. Passenger vehicle 107 has a negative driven acceleration C. Passenger vehicle 107 further has a centripetal acceleration G in opposite direction to, and a tangential acceleration K perpendicular to, negative driven acceleration C. Passenger 109 within passenger vehicle 107 feels a net radial acceleration P of passenger vehicle 107. Radial motion is guided by platform track 103 of rotating platform 101. Rotating platform 101 has counterclockwise constant angular speed A.

Figure 3A:
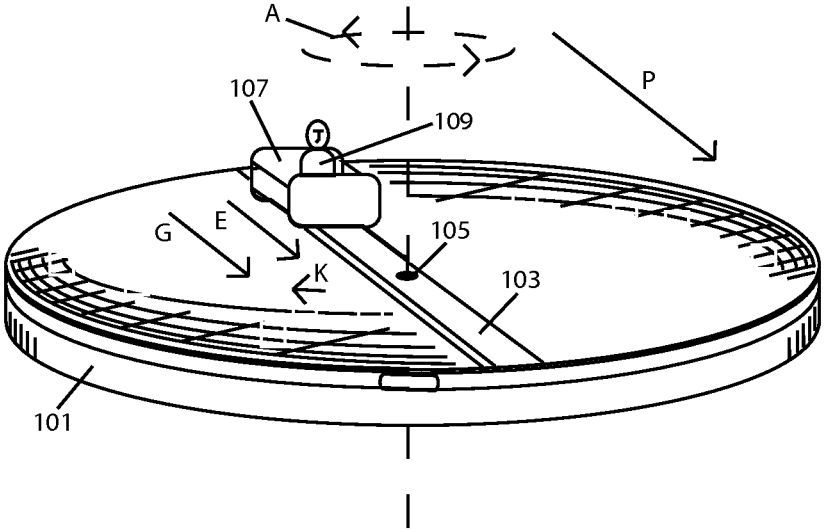
FIGS. 3A and 3B are side and top views, respectively, of a preferred machine in step three of the A.L.A.S. maneuver.
Figure 3B:
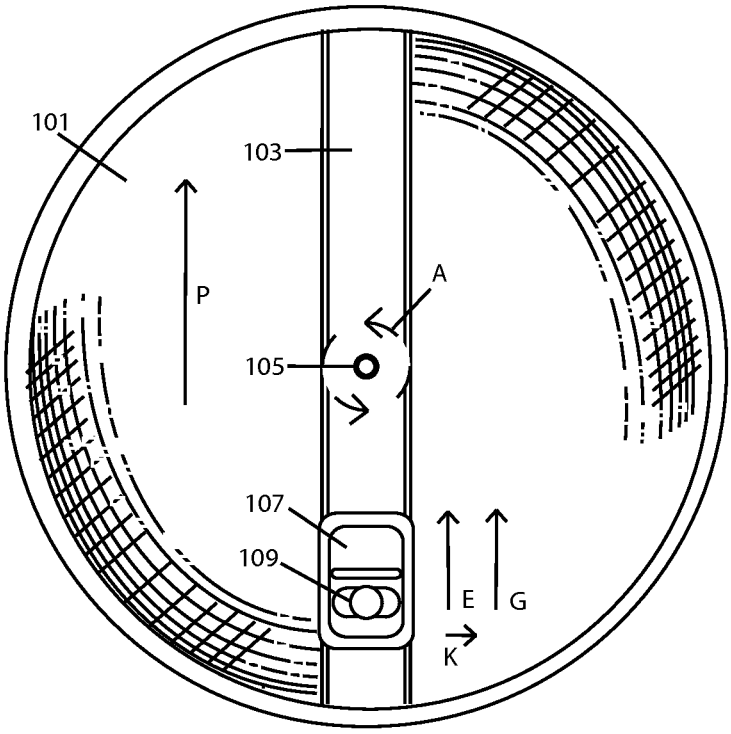

In FIG. 3A (side view) and FIG. 3B (top view), step three of the A.L.A.S. maneuver is displayed. Passenger 109 is within passenger vehicle 107. Passenger vehicle 107 has a positive driven acceleration E. Passenger vehicle 107 further has centripetal acceleration G in same direction to, and tangential acceleration K perpendicular to, positive driven acceleration E. Passenger 109 within passenger vehicle 107 feels net radial acceleration P of passenger vehicle 107. Radial motion is guided by platform track 103 of rotating platform 101. Rotating platform 101 has counterclockwise constant angular speed A.

In FIG. 4, the fundamental steps of the A.L.A.S. maneuver are outlined in flowchart form.

In FIG. 5, a computer program, written in C programming language, presents kinematic modeling of the A.L.A.S. maneuver in procedural form. No part of the code has been modularized for ease of understanding the logic. The values listed in FIG. 5 are specified to a first embodiment of the A.L.A.S. maneuver. All kinematic values in the computer program are defined according to the International System of Units.

In FIG. 5, three computational iterations are executed for, and in a same temporal order as, steps of the A.L.A.S. maneuver. Values for centripetal acceleration G, tangential acceleration K, negative driven acceleration C, positive driven acceleration E, and net radial acceleration P, as described above, are calculated as variables centripetalAccel, tangentialAccel, negDrivenAccel, posDrivenAccel, and netAccel, respectively. A distance traveled by passenger vehicle 107 along platform track 103, per a time period defined as variable stepTime, is computed as variable radialVar. A total distance traveled by passenger vehicle 107 away from central axis of rotation 105 is defined as variable radialPos. Constant angular speed A of rotating platform 101 is defined as variable angularVel. A variable loopValue is an integer increment value for second and third iterations and aids in calculation of negative driven acceleration C and positive driven acceleration E of passenger vehicle 107. The last calculated acceleration in the program is net radial acceleration P, which for this publication is vector addition of centripetal acceleration G and driven acceleration. Furthermore, driven acceleration has values of negative driven acceleration C in the second iteration and positive driven acceleration E in the third iteration.

Figure 6A:
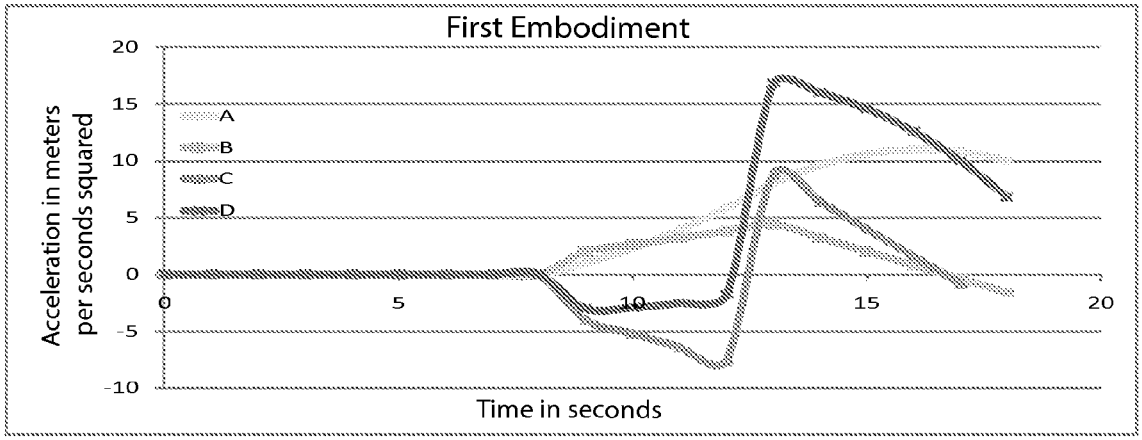
FIGS. 6A, 6B, and 6C are graphs for first, second, and third embodiments of the A.L.A.S. maneuver, respectively, and present centripetal, tangential, driven, and net radial accelerations of the passenger vehicle during all stages of the A.L.A.S. maneuver.
Figure 6B:
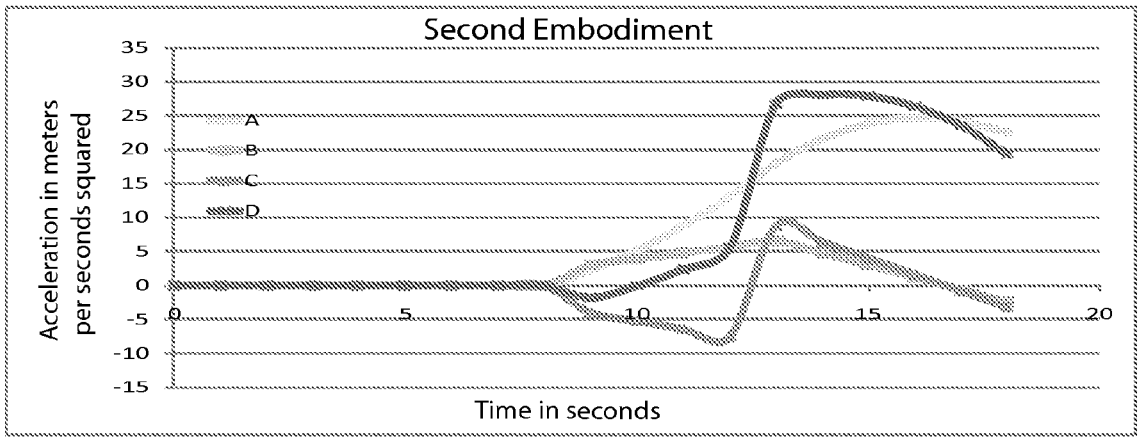
Figure 6C:
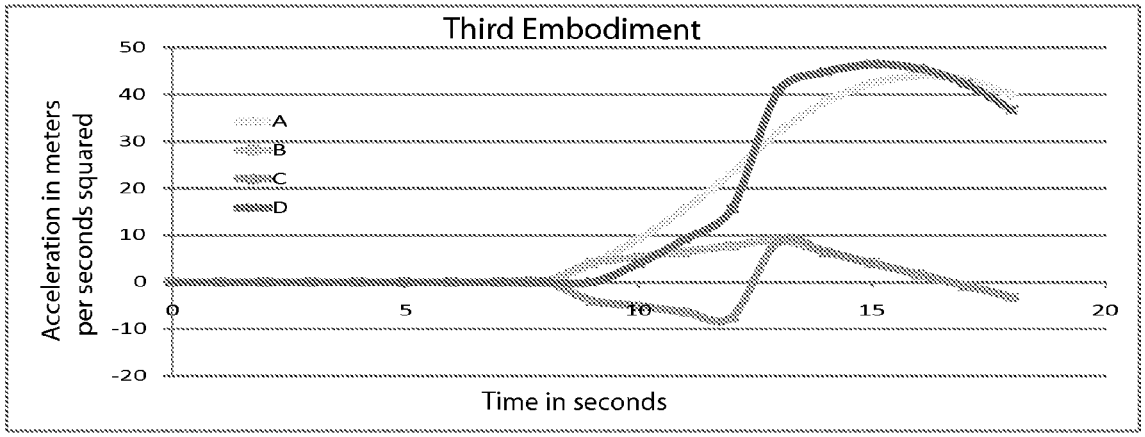

In FIGS. 6A, 6B, and 6C, line A is centripetal acceleration G, line B is tangential acceleration K, and line D is net radial acceleration P of the A.L.A.S. maneuver. Furthermore, values for negative driven acceleration C and positive driven acceleration E are plotted on a same line, line C, to represent all values of driven acceleration for the full duration of the A.L.A.S. maneuver. In FIG. 6A, a graph of centripetal, tangential, driven, and net radial accelerations of a first embodiment experienced by passenger 109 within passenger vehicle 107 during the A.L.A.S. maneuver is presented. In FIG. 6B, a graph of centripetal, tangential, driven, and net radial accelerations of a second embodiment experienced by passenger 109 within passenger vehicle 107 during the A.L.A.S. maneuver is presented. In FIG. 6C, a graph of centripetal, tangential, driven, and net radial accelerations of a third embodiment experienced by passenger 109 within passenger vehicle 107 during the A.L.A.S. maneuver is presented.

Operation—FIGS. 1A, 1B, 2A, 2B, 3A, 3B, 4, 5, 6A, 6B, 6C In FIGS. 1A, 1B, 2A, 2B, 3A, and 3B, the A.L.A.S. maneuver is accomplished by sequence of 1) moving passenger 109, within passenger vehicle 107, at constant angular speed A on rotating platform 101 about central axis of rotation 105 (FIGS. 1A and 1B), 2) moving passenger 109, within passenger vehicle 107, at constant angular speed A on rotating platform 101 about central axis of rotation 105 and moving passenger 109, within passenger vehicle 107, away from central axis of rotation 105 at an increasing speed by negative driven acceleration C (FIGS. 2A and 2B), and 3) moving passenger 109, within passenger vehicle 107, at constant angular speed A on rotating platform 101 about central axis of rotation 105 and moving passenger 109, within passenger vehicle 107, away from central axis of rotation 105 at a decreasing speed by positive driven acceleration E (FIGS. 3A and 3B). The source of driven acceleration can be a motor in passenger vehicle 107 or platform track 103, but the essential distinction is that the sources of driven acceleration and centripetal acceleration G are separate so that their vectors exist independently of one another. To this end, these separate radial accelerations are crafted so that they are moving in opposite directions in the second step but moving in the same direction in the third step of the A.L.A.S. maneuver.

In FIG. 4, a flowchart presents the sequence of the A.L.A.S. maneuver in which all steps are followed in temporal order of execution and removal of any step would result in losing a full effect of the A.L.A.S. maneuver.

In FIG. 5, a computer program models kinematic motions of a first embodiment of the A.L.A.S. maneuver. A main body of the program is displayed from line one to line forty. Lines four through five declare variables centripetalAccel, tangentialAccel, negDrivenAccel, posDrivenAccel, and netAccel for calculation of centripetal acceleration G, tangential acceleration K, negative driven acceleration C, positive driven acceleration E, and net radial acceleration P, respectively. Lines six through ten declare and define variables radialPos, radialVar, angularVel, stepTime, and loopValue, for values of a first embodiment. The variable angularVel is constant angular speed A. The remainder of the program main body is dedicated to three iterations. All iterations calculate accelerations of passenger 109, within passenger vehicle 107, as kinematic data. Lines twelve through eighteen execute step one of the A.L.A.S. maneuver, lines nineteen through twenty-eight execute step two, and lines twenty-nine through thirty-eight execute step three. Kinematic values for all variables are calculated exactly as shown.

In FIGS. 6A, 6B, and 6C, three preferred embodiments of the A.L.A.S. maneuver are presented. FIG. 6A is a first embodiment of the A.L.A.S. maneuver and is an effect that would be desired for a low acceleration thrill park ride, or similar methods, as net radial acceleration P peaks at approximately 1.75 Gs of force. In this embodiment, value for angularVel is 1.0 rad/s and stepTime is equal to 0.5 s. FIG. 6B is a second embodiment of the A.L.A.S. maneuver and is an effect that would be desired for a high acceleration thrill park ride, or similar methods, as net radial acceleration P peaks at approximately 2.85 Gs of force. In this embodiment, value for angularVel is 1.5 rad/s and stepTime is equal to 0.5 s. FIG. 6C is a third embodiment of the A.L.A.S. maneuver and is of an effect that would be desired for a military operation of simulation training, or similar methods, as net radial acceleration P peaks at approximately 5 Gs of force. In this embodiment, value for angularVel is 2.0 rad/s and stepTime is equal to 0.5 s.

CONCLUSION

Accordingly, the reader will see that three embodiments of the A.L.A.S. maneuver are a consistent and reliable application of a method that solves a current but not fully recognized problem in fields of roller coasters, motion simulators, and similar thrills rides; a competing need between spatial and temporal resources in amusement rides currently limits motion and simulator parameters. Creating a unique three step routine via a system of centripetal and longitudinal motions and utilizing only one central axis of rotation, the A.L.A.S. maneuver produces a quick and powerful linear acceleration of a passenger vehicle over a small period of time and within a confined space, resulting in a quick and powerful force acting upon a passenger, or passengers, within the passenger vehicle. Furthermore, the preferred embodiments of the method attain additional advantages of reduced manufacturing, operational, and maintenance costs over prior art technologies.

The above description provides three embodiments with a preferred machine, however, this does not limit the A.L.A.S. maneuver from operating in other applications and technologies or through additional embodiments. For example, a retracting arm carrying a passenger or passengers, within a passenger vehicle, and connected to and retracting away from a rotating axis could likewise execute the A.L.A.S. maneuver. Also for consideration, smaller scaled versions of the preferred machine employing the A.L.A.S. maneuver could be used in fields of experimental protocols to aid in force analyses or manufacturing to process materials separation.

Furthermore, values chosen above for constant angular speed, positive driven acceleration, negative driven acceleration, and other variables, are suggested quantities and proposed operational ranges for accelerations, positions, time and other parameters. Accordingly, the scope of the A.L.A.S. maneuver should be judged only by the content of the claims and their legal equivalents.

In closing, it is hoped that manufacturers in fields of roller coasters, motion simulators, and similar thrill rides will fully acknowledge the problem and solution this publication has identified as limitations of motion and simulator parameters by a competing consumption of temporal and spatial resources within fields of amusement rides and the A.L.A.S. maneuver, respectively.

What is claimed is:

1. A method for generating aggressive linear acceleration forces on a passenger, within a passenger vehicle, comprising sequentially performing the steps of:

moving said passenger, within said passenger vehicle, at a constant angular speed about a central axis of rotation;

while maintaining said constant angular speed about said central axis of rotation, providing an acceleration force on said passenger, within said passenger vehicle, in an outward direction away from said central axis of rotation; and while maintaining said constant angular speed about said central axis of rotation, providing an acceleration force on said passenger, within said passenger vehicle, in an inward direction toward said central axis of rotation.

2. The method of claim 1, wherein said central axis of rotation is centrally located through a rotating platform on which said passenger vehicle sits on and rotates with a tangential acceleration and a centripetal acceleration.

3. The method of claim 1, wherein said acceleration force in an outward direction away from said central axis of rotation and said acceleration force in an inward direction toward said central axis of rotation are provided via a platform track that rotates with said passenger vehicle about, and through, said central axis of rotation and which said passenger vehicle sits on and is linearly movable on.

4. The method of claim 1, wherein providing an acceleration force on said passenger, within said passenger vehicle, in an outward direction away from said central axis of rotation comprises providing a negative driven acceleration force having a substantially same magnitude and opposite direction as a centripetal acceleration force provided by the movement of said passenger within said passenger vehicle at said constant angular speed about said central axis of rotation, thereby producing a substantially zero net radial acceleration of said passenger vehicle.

5. The method of claim 1, wherein providing an acceleration force on said passenger, within said passenger vehicle, in an inward direction toward said central axis of rotation comprises providing a positive driven acceleration force having a same direction as a centripetal acceleration force provided by the movement of said passenger within said passenger vehicle at said constant angular speed about said central axis of rotation, thereby producing an additive net radial acceleration of said passenger vehicle.

6. A machine for generating aggressive linear acceleration forces on a passenger vehicle comprising:

a symmetric rotating platform configured to rotate about a central axis of rotation; and a platform track extending through said central axis of rotation, coupled with and configured to rotate on said rotating platform, wherein said passenger vehicle is coupled with said platform track and said rotating platform, and said machine is operationally configured to perform in sequence the steps of:

rotating said passenger vehicle via said rotating platform at a constant angular speed about said central axis of rotation;

providing an acceleration force on said passenger vehicle in an outward direction along said platform track away from said central axis of rotation, while maintaining said constant angular speed about said central axis of rotation, and providing an acceleration force on said passenger vehicle in an inward direction along said platform track toward said central axis of rotation, while maintaining said constant angular speed about said central axis of rotation.

7. The machine of claim 6, wherein providing an acceleration force on said passenger vehicle in an outward direction along said platform track away from said central axis of rotation comprises providing a negative driven acceleration force having a substantially same magnitude and opposite direction as a centripetal acceleration force provided by the rotation of said passenger vehicle at said constant angular speed about said central axis of rotation, thereby producing a substantially zero net radial acceleration of said passenger vehicle.

8. The machine of claim 6, wherein providing an acceleration force on said passenger vehicle in an inward direction along said platform track toward said central axis of rotation comprises providing a positive driven acceleration force having a same direction as a centripetal acceleration force provided by the rotation of said passenger vehicle at said constant angular speed about said central axis of rotation, thereby producing an additive net radial acceleration of said passenger vehicle.

* * * * *